US006125876A

United States Patent [19]

Laederich et al.

[11] Patent Number: 6,125,876

[45] Date of Patent: Oct. 3, 2000

[54] APPARATUS AND PROCESS FOR DELIVERING AN ABRASIVE SUSPENSION FOR THE MECHANICAL POLISHING OF A SUBSTRATE

[75] Inventors: Thierry Laederich, Pionsat; Georges Guarneri, Saint Martin d Heres; Hervé Dulphy, Grenoble, all of France

[73] Assignee: L'Air Liquide, Societe Anonyme pour l'Etude et l'Exploitation des Procedes Georges Claude, Paris, France

[21] Appl. No.: 09/223,497

[22] Filed: Dec. 29, 1998

[30] Foreign Application Priority Data

Aug. 18, 1998 [FR] France ..... 98 10508

[51] Int. Cl.[7] ..... E03B 11/00

[52] U.S. Cl. ..... 137/255; 137/256; 137/263; 222/1; 222/3; 222/61; 222/71; 222/129; 222/134

[58] Field of Search ..... 222/1, 61, 71, 222/3, 129, 134; 137/256, 263, 255

[56] References Cited

U.S. PATENT DOCUMENTS 5,148,945 9/1992 Geatz ..... 222/1
5,330,072 7/1994 Ferri, Jr. et al. ..... 222/1
5,503,139 4/1996 McMahon et al. ..... 128/200.2
5,722,447 3/1998 Morgan et al. ..... 137/1

FOREIGN PATENT DOCUMENTS 0 849 778 6/1998 European Pat. Off. .
WO 96/02319 2/1996 WIPO .

*Primary Examiner*—Deborah Jones
*Assistant Examiner*—Lymane Miranda
*Attorney, Agent, or Firm*—Burns, Doane, Swecker & Mathis, LLP

[57] ABSTRACT

An apparatus for delivering abrasive suspensions includes a reservoir containing an abrasive suspension, a loop for delivering the abrasive suspension to a point of use, the loop being connected to the reservoir, a pumping arrangement for circulating the abrasive suspension in the loop and for ensuring its return into the reservoir, the loop and the reservoir being arranged for recovering the abrasive suspension after circulation in the loop at a recovery point of the reservoir, and a control system for controlling the pumping arrangement so as to maintain a continuous circulation of the suspension.

20 Claims, 2 Drawing Sheets

APPARATUS AND PROCESS FOR DELIVERING AN ABRASIVE SUSPENSION FOR THE MECHANICAL POLISHING OF A SUBSTRATE

This application claims priority under 35 U.S.C. §§119 and/or 365 to 98 10508 filed in France on Aug. 18, 1998; the entire content of which is hereby incorporated by reference.

BACKGROUND OF THE INVENTION

1. Field of the Invention

The present invention relates to an apparatus and to a process for delivering an abrasive suspension for the mechanical polishing of substrates.

2. Description of the Related Prior Art

The use of a silica suspension or alumina suspension for the polishing of silicon wafers on the rear face as well as the front face tend to be commonplace in the semiconductor industry, the optoelectronics industry and the optics industry. The problem naturally arises of how to deliver this product, from the supply drum, to several points of use. Such suspensions may also be used for polishing a metal layer already deposited on the silicon wafer; in this case, these suspensions may have physical or chemical properties that differ from the first.

The physico-chemical properties, viscosity, solids content and pH contribute to make these suspensions readily solidifiable if they are not periodically stirred. As a result, the pipes for delivering these suspensions often block up due to the latter solidifying, and the polishing of the silicon wafers exhibits defects characterized by deep scratches due to the detachment of agglomerates of solidified silica or alumina; the delivery pipes must therefore be frequently replaced and all this results in high operating costs and very low equipment utilization levels.

The various methods of delivering abrasive suspensions (or slurries) in the process of chemical and/or mechanical polishing of silicon wafers may be summarized as follows:

The most conventional method of delivering these abrasive suspensions consists in using pumps connected to pipes which take the product to the point of use. However, the nature of abrasive suspensions, especially because they contain abrasive particles on the one hand and because they either have a very acid or a very basic pH on the other hand, results in very rapid degradation of the pumps used, causing very serious maintenance problems: these delivery systems can only operate for a short period, most of the time being spent replacing, unblocking and maintaining the circuit. Even by using pumps based on polytetrafluoroethylene, the diaphragms in these pumps must be replaced every two to three months.

A system for the vacuum delivery of chemicals is known from U.S. Pat. Nos. 5,148,945 and 5,330,072, in which, instead of using pumps, intermediate containers are used which are put under vacuum sequentially so as to suck out the chemicals and to pressurize them in order to force them to be directed to the point of use. Although such a system does not use a pump, it is impossible with such a system to deliver abrasive suspensions such as those used in particular for removing metals on surfaces. This is because such suspensions have an extremely short lifetime before they solidify and because they are very corrosive.

An apparatus is also described, in Application WO 96/02319, which firstly comprises a measurement container into which the various chemicals used in the abrasive suspension are alternately taken, the said chemicals being quantitatively determined in this measurement container, each chemical, after being measured, then being sent to a mixing container in which all the compounds of the suspension are mixed in situ, this mixing container itself being connected to a container in which a negative pressure or a vacuum is created so as to suck out the suspension which is in the mixing container and send it to the various stations for delivering the abrasive suspension.

At the present time, there is a need for apparatuses distributing abrasive suspensions which do not require a great deal of maintenance and which may be available when the need arises.

SUMMARY OF THE INVENTION

The apparatus according to the invention is characterized in that it comprises a tank, in which an abrasive suspension to be delivered is placed, a loop for delivering the suspension, connected at its two ends to the delivery tank, circulation means for making the abrasive suspension circulate in the loop, recovery means for recovering the abrasive suspension after circulation in the loop, and means for controlling the circulation means so as to maintain a continuous circulation of the abrasive suspension in the loop (preferably at least when the apparatus is in operation, that is to say in the state in which it is delivering the suspension to the points of use).

Preferably, a loop for delivery to the point of use will be used which consists of a plurality of loops arranged in parallel, preferably with each loop comprising at least one arm common to all the loops, one of the ends of the plurality of loops being connected to one of the ends of the common arm. Preferably, this loop will comprise two common arms connected by their respective first ends to a plurality of subloops connected in parallel, the first common arm being connected by its second end to the abrasive suspension tank and the second common arm being connected by its second end to means for recovering the abrasive suspension. Also preferably, the length of each pipe (whatever the loop) between the tank and the point of delivery of the suspension will be approximately the same, while the length of each pipe between the point of delivery and the means for recovering the abrasive suspension will also be preferably approximately the same.

In order to obtain continuous and uniform circulation of the abrasive suspension, it is preferable to provide control means on the apparatus according to the invention and these control means will preferably either be means for controlling the pressure of the abrasive suspension in the pipes or means for controlling the flow rate of the abrasive suspension in the said pipes (or optionally both in combination). Preferably, a minimum flow rate in the delivery pipes will be chosen so as to prevent the abrasive suspension from being deposited on the walls of the delivery pipes, which would block the pipes. This is, in fact, one of the major advantages of the invention, namely to prevent in this way the pipes from becoming blocked, which is a major problem existing in the currently known plants. By making the abrasive suspension circulate continuously in the pipes preferably at a rate of greater than or equal to approximately 0.2 m/s and also preferably at a rate of less than or equal to approximately 10 m/s, the problems caused by these pipes becoming obstructed are thus prevented, which obstructions often result from hardening and/or coagulation of the abrasive suspension. Preferably, the flow rate will be between approximately 0.5 m/s and approximately 2 m/s and more preferably between approximately 1 and 1.2 m/s.

In order to circulate this abrasive suspension, a pump will preferably be used as it was recognized that by using a circulation pump while maintaining a continuous circulation of the abrasive suspension the problems usually encountered in the pumps of the prior art, namely blocking of the filters, obstruction of the pump, etc., were avoided. However, and in order for the apparatus according to the invention to have maximum reliability, it will be preferred to place two circulation pumps in parallel, each of the two pumps preferably operating only at approximately (and at most) 50% of its power. This means that, should one of the two pumps break down, it is possible to continue normal operation of the apparatus with a single pump, which will then operate at 100% of its power. Of course, in this case, there will be an alarm which will indicate when one of the pumps is blocked or is defective or when the flow of material leaving one of the pumps is practically zero.

According to another particularly advantageous embodiment of the invention, and so as to avoid the use of pumps, especially if the abrasive suspension is highly corrosive, the suspension will be made to circulate using pressurized gas, preferably a pressurized inert gas such as nitrogen and/or argon and/or helium. However, it has been observed in this case that, despite everything, a pipe blockage may occur. The Applicant has shown that, in the case of circulation using pressurized gas, such a blockage could be avoided by ensuring that the pressurized gas used for the circulation is at a minimum relative humidity. For this purpose, it will be preferred to vaporize or nebulize deionized water (which has all the desired purity characteristics for electronic applications) in the inert gas before injecting it into the pipes so as to maintain a sufficient humidity in the gas, to prevent the abrasive suspension from drying out and thus to prevent the filters from clogging up. By using a suitable water concentration in the pressurized gas within the limit of the rates normally used and mentioned above, any clogging of the pipes is prevented.

BRIEF DESCRIPTION OF THE FIGURES OF THE DRAWING

The invention will be more clearly understood with the aid of the following embodiments given by way of non-limiting examples, together with the figures which show.

DETAILED DESCRIPTION OF THE PREFERRED EMBODIMENTS

Figure 1:
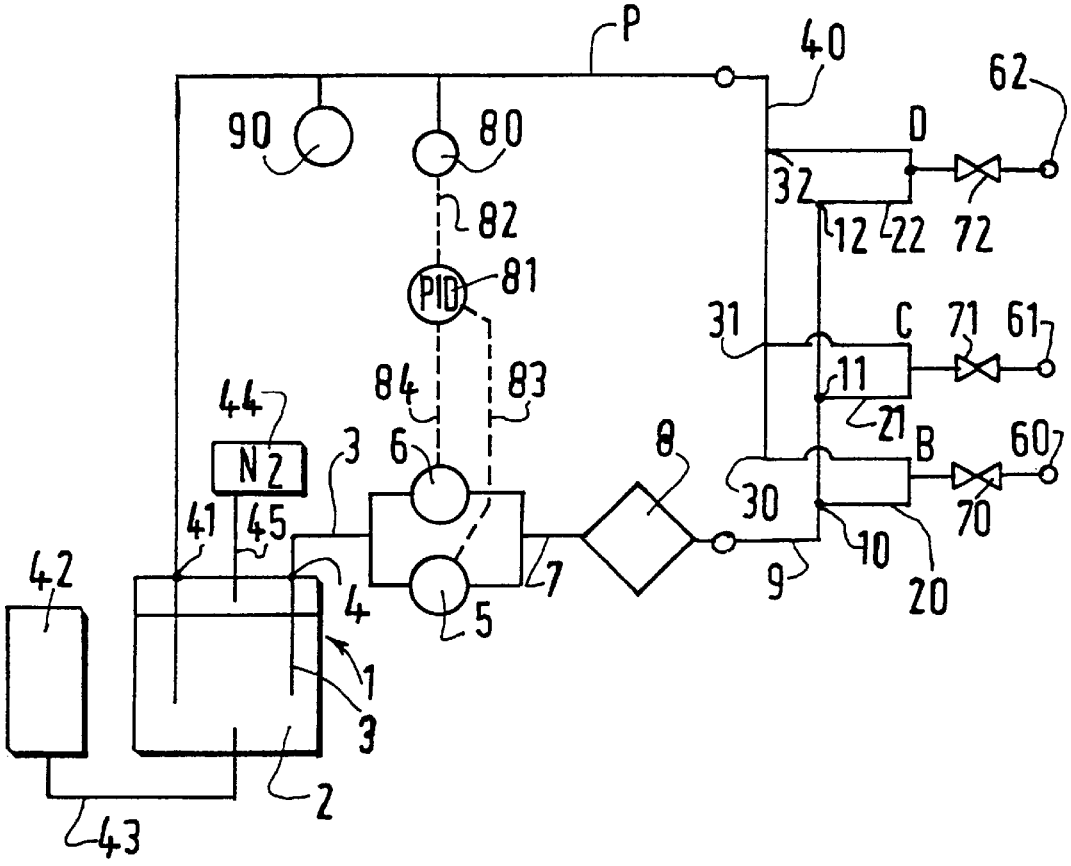
FIG. 1, a first embodiment of an apparatus according to the invention and implementing the process according to the invention, FIG. 2, an alternative embodiment of FIG. 1.

In FIG. 1, a tank 1 contains an abrasive suspension 2 drawn off by a pipe 3 which passes through the wall of the tank 1 at the point 4 and continues as far as the two pumps 5 and 6 placed in parallel on this pipe, the outlets of which are connected together once more to the pipe 7 connected to the filter 8 which runs into the pipe 9. Pipes 20, 21, . . . 22, are connected to the points 10, 11, . . . 12, respectively, the other ends of these pipes, 30, 31, . . . 32, respectively, are connected together to the pipe 40 for returning the abrasive suspension to the tank 1, this pipe 40 passing through the wall of the said tank at 41 and emerging in the suspension 2 contained in this tank 1. A filling tank 42 is placed in parallel with the tank 1 and connected to the latter by a pipe 43 so as to maintain, under all circumstances, a level which is always above a certain predetermined minimum in the tank 1. This ancillary tank 42 is used in particular to adjust the viscosity of the abrasive suspension.

Also provided, connected by the pipe 45 to the tank 1, are means 44 for injecting a pressurized gas, such as an inert gas, preferably nitrogen, having a purity compatible with the desired application, especially a purity of the N50 type or better. Placed between the connections 10,30, 11,31, . . . 12,32, respectively, are points B, C, . . . D, respectively, for delivering the abrasive suspension to the points of use, 60, 61, . . . 62, respectively, via valves 70, 71, . . . 72, respectively. It will be preferred to use pipes with the same diameter in the various loops, 20, 21, . . . 22, respectively, and the same distance will be maintained between the point 4 and the points B, C, . . . , D, respectively (or, if the diameters are different, lengths such that the head losses are identical in each line) . In this way, the pressures $P_a$, $P_b$, . . . $P_c$ which are the pressures of the abrasive suspension at the points B, C, D, respectively, are approximately equal, thereby allowing uniform delivery of the product. The apparatus also comprises, between the point 32 and the point 41 on the line 40, a pressure detector 80 which is connected electrically to a PID (Proportional/Integral/Differential)-type control system 81 which itself is connected electrically, via the lines 83 and 84 respectively, to the pumps, 5 and 6 respectively. The pressure has to be maintained at a pressure equal to the set pressure set in the PID, and when the pressure detected by 80 is less than the displayed pressure, an electrical signal is generated by the PID 81 so as to increase the pumping pressure of the pumps 5 and 6. When the pressure measured by the pressure detector 80 again becomes equal to or greater than the pressure displayed in the PID 81, the latter corrects the signal sent by the lines 83 and 84 to the pumps 5 and 6 so as to bring the pumping pressure of the pumps 5 and 6 back to the value corresponding to the set value of the pressure. Conversely, the PID reduces the pumping pressure of the pumps by sending a suitable electrical signal to the pumps 5 and 6 if the pressure detectors detect a pressure greater than the set pressure displayed in the PID 81.

Figure 2:
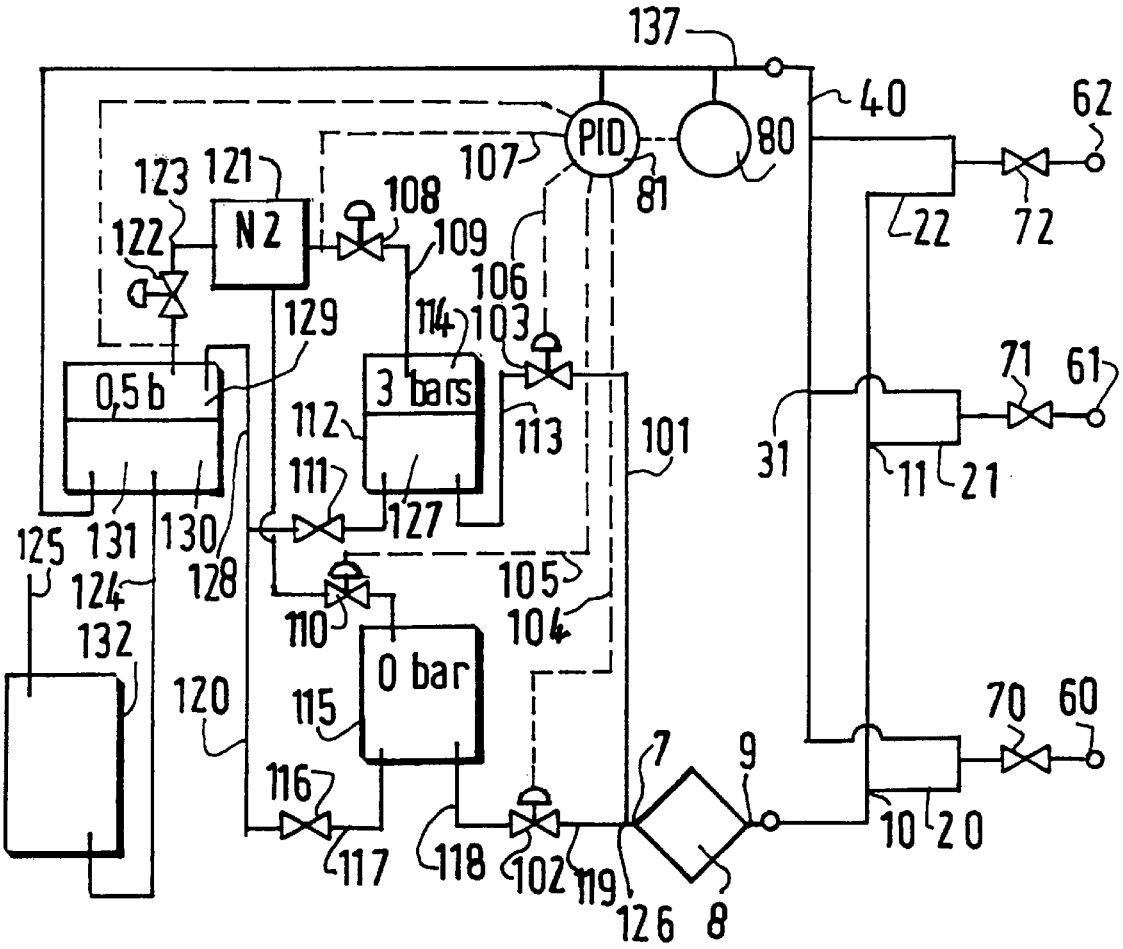

The apparatus may also comprise a flow control system, either by itself (without the pressure detection system with the PID) or in addition to the pressure detection system. This flow control system consists especially in measuring the flow rate of the solution of the abrasive suspension and in comparing the measured value with a set value and then in increasing or decreasing the output of the pumps 5 and 6 by sending a corresponding electrical signal to the said pumps after comparing the flow rate measured with the flow rate displayed. FIG. 2 shows an alternative embodiment of the apparatus in FIG. 1, in which in particular at least two tanks for storing the abrasive suspension are used, these being connected in parallel and used alternately; thus, when one tank is empty and this state is detected, for example by a level detector, the second tank may be automatically put into operation without needing to interrupt the circulation of the abrasive suspension, thereby preventing the problems of coagulation and of pipe blockage and therefore reducing the maintenance of the apparatus. (In this FIG. 2, the same devices as those in FIG. 1 bear the same references).

The two pipes 101 and 119, which are respectively connected to the abrasive suspension tanks 112 and 115 via the controlled-opening valves 103 and 102 and the pipes 113 and 118, respectively, are joined together at the point 126. In FIG. 2, the tank 112 is under a pressure of an inert gas, for example nitrogen (which is ultrapure or of "electronic" purity for use of the suspension for polishing silicon wafers) at a pressure of, for example, approximately 3 bar in the space 114 above the suspension 127. When 112 is empty, the suspension is supplied via the valve 111 (which is open for filling and then closed when in use—see below) and the pipe 128 which emerges at 129 in the reserve 130 in the return tank 131. Likewise, the bottom of the tank 115 is connected via the pipe 117, the valve 116 and the pipe 120 to the pipe 128 so as to fill 115 when the latter is empty (the valve 116 being open and the valve 111 closed) and so as to fill 112 when 111 is open and 116 is closed (or to fill neither of them when 111 and 116 are closed).

The source of pressurized nitrogen 121 makes it possible to control the gas pressures above the suspension via the valves 108 and 110 respectively (these valves being controlled by a control device 81 well known to those skilled in the art, of the "Proportional" (P) , "Integral" (I) , "Differential" (D) or "PID" type) allowing the pressures to be set, for example, to 3 bar (relative) above 127 (in order to push the suspension into 113) and to 0 bar (relative) in 115 in order to allow 115 to be filled with the suspension. 121 is also connected via the pipe 131 and the controlled valve 122 (which may or may not be also controlled by the PID 81) which maintains a nitrogen pressure, for example of 0.5 bar (relative) above the suspension 130.

The pipe 137 for returning the surplus suspension goes back into the tank 131.

In order to ensure additional supply to the tank 131, in order to compensate for the consumption of suspension upstream, a large-capacity tank 132 is provided which supplies 131 via the pipe 124. This tank 132 may also be raised in order to supply the other tanks by gravity (optionally, the top of the tank may also be pressurized with ultrapure nitrogen via the pipe 125). This mode of transport, not using a pump but rather gas pressure, avoids the problem of pumps seizing up.

Several other tanks, such as 112, 115 may also be placed in parallel with one another.

In FIG. 1, the tank 2 has a volume large enough for the equipment to preferably be self-sufficient for about 2.5/3 days. Preferably, it is continuously stirred mechanically and maintained at a slight overpressure (1 to 3 mbar) so as to prevent atmospheric $CO_2$ acting on the aqueous ammonia contained in certain abrasive suspensions. The tank is made of a plastic to which there is no risk of solidifying silica or alumina adhering. Draw-off from the tank preferably takes place via a bottom valve; return flow from the loop takes place via a valve dropping below the minimum level in the tank. The tank is filled with the aid of a positive displacement pump from shuttle drums. Should dilution in water be necessary, this may be done by continuously injecting water and a silica suspension into a static mixer. After each shuttle drum 42 has been discharged, the silica supply circuit for the storage tank, including pumps and pipe, is purged with deionized water.

Given the abrasive nature of the suspension to be circulated, it will be preferred in practice to operate the two pumps in parallel at half their rated speed, each pump being preferably connected to a variable-frequency (0–100 Hz) supply which is controlled by a current (for example from 4 to 20 mA); the 2 variable-frequency supplies are slaved by a PID controller 81 to the pressure at the end of the loop just before the control valve.

Ceramic gear pumps may, for example, be chosen. To ensure normal longevity of the seals, the shaft of each pump will preferably be equipped with 2 seals, the space (bell) between the seals being maintained at an overpressure with respect to the silica by injecting deionized water. The deionized-water supply circuit will comprise, at its inlet, a 100–200 1/h calibrated orifice and a 10–20 1/h calibrated orifice at its outlet. The pressure in the bell should be constant if there is no leak at the internal seal in contact with the silica. On the other hand, if there is a leak, the pressure in the bell between the 2 seals will gradually drop and a pressure sensor will allow alarm signals to be sent and corrective action to be organized. Preferably, provision will also be made for the pumps to be automatically purged with deionized water should they stop.

These arrangements have the following advantages:

- limited wear in an abrasive medium by virtue of the low rotation speed of the pumps;
- the use of 2 pumps makes it possible to maintain the flow rate and the pressure in the loop should one pump fail, the second automatically increasing its speed in order to compensate;
- should there be significant draw-off, the pressure in the return to the tank dropping, the pumps increase their speed in order to keep the flow rate constant. If, for example, the equipment draws off more than the rated output from the loop, there is automatic compensation and the flow in the loop never stops. Conversely, when draw-off ceases, the pressure will have a tendency to increase and the PID controller will reduce the control frequency of the pumps. The pressure variations in the delivery network are also of small amplitude, for example ±100 g, this being important for the metering of the abrasive solution in polishing equipment.

The loop (in its common arm 7, 9) is equipped with a filter 8, preferably of the polypropylene "bag" type, preferably stopping at least 90% of the materials having a size of greater than about 100 micrometers. Given the nature of this suspension, it will be advantageous to oversize this filter so as to operate with a reduced differential pressure, of 0.1 to 0.2 bar.

All the circuits branched off from the delivery loop have approximately the same head loss. Each loop (delivery) is served by an outflow Tee and a return Tee, each Tee being equipped with an isolating valve. The "return" isolating valve is equipped with a calibrated orifice which has two functions:

to distribute the flow in the various branches of the network in an equal manner;

the draw-off by each piece of equipment (delivery) which takes place by a Tee upstream of the orifice does not in this way cause a significant drop in pressure.

The diameter of the calibrated orifices depends on a number of parameters such as the flow rate in the loop, the pressure in the loop, the number of pieces of equipment to be served and the viscosity of the suspension to be delivered, elements which those skilled in the art may choose without difficulty in order to ensure flow rates preferably between 0.2 and 0.5 m/s in order to minimize the abrasion of the pipes.

The delivery loop preferably includes an abrasion-resistant non-slaved control valve (not shown in the figure) and, upstream of the latter, a flow meter 90 and a pressure sensor 80.

The flow rate is controlled using the control valve, which is not slaved to the chosen value, and the set pressure is displayed at the PID controller 81, the parameters of which are adjusted so as to obtain satisfactory operation of the loop, especially during small pressure variations upon draw-off, upon switching on and/or upon operating with 1 pump.

It should be noted that the system described above might also operate in particular using bellow or membrane air pumps, in common use in the semiconductor industry, on condition that the driving gas is injected via a controlled valve or a device of the type which controls the mass flow rate, slaved by an external set value given by a pressure regulator. In this case, the operation using 2 pumps in parallel, running at half their rated output, will be maintained so as to obtain a high level of utilization.

What is claimed is:

1. Apparatus for delivering abrasive suspensions, comprising:

a reservoir containing an abrasive suspension;

a loop for delivering the abrasive suspension to a point of use, the loop being connected to the reservoir;

a pumping arrangement for circulating the abrasive suspension in the loop and for ensuring its return into the reservoir;

the loop and the reservoir being arranged for recovering the abrasive suspension after circulation in the loop at a recovery point of the reservoir; and a control system for controlling the pumping arrangement so as to maintain a continuous circulation of the suspension, wherein the pumping arrangement includes a source of a pressurized gas connected to the reservoir, and the pumping arrangement further includes means for nebulizing deionized water in the pressurized gas.

2. Apparatus according to claim 1, wherein the loop for delivery to the point of use includes a plurality of loops connected in parallel.

3. Apparatus according to claim 2, wherein the loop comprises at least one arm common to all the loops, an end of each of the loops being connected to an end of the at least one common arm.

4. Apparatus according to claim 3, wherein the loop comprises two common arms, a first arm being connected at a first end to the reservoir and a second arm being connected at a first end to the recovery point.

5. Apparatus according to claim 1, wherein the loop comprises a plurality of pipes, and the loop delivers the abrasive suspension to a plurality of delivery points, a length of each pipe between the reservoir and a respective one of the plurality of delivery points is approximately the same.

6. Apparatus according to claim 1, wherein the loop comprises a plurality of pipes, and the loop delivers the abrasive solution to a plurality of delivery points, lengths of each pipe between a respective one of the plurality of delivery points and the recovery point is approximately the same.

7. Apparatus according to claim 1, wherein the control system includes a pressure controller for controlling pressure in the loop.

8. Apparatus according to claim 1, wherein the control system includes a flow controller for controlling a rate of flow of the abrasive solution in the loop.

9. Apparatus according to claim 1, wherein the loop comprises one or more pipes, and the control system is arranged to control the pumping arrangement to maintain the abrasive suspension at a minimum flow rate in the loop to prevent the abrasive suspension from being deposited on walls of the pipes.

10. Apparatus for delivering abrasive suspensions, comprising:

a reservoir containing an abrasive suspension;

a loop for delivering the abrasive suspension to a point of use, the loop being connected to the reservoir;

a pumping arrangement for circulating the abrasive suspension in the loop and for ensuring its return into the reservoir;

the loop and the reservoir being arranged for recovering the abrasive suspension after circulation in the loop at a recovery point of the reservoir; and a control system for controlling the pumping arrangement so as to maintain a continuous circulation of the suspension, wherein the loop comprises one or more pipes, and the control system is arranged to control the pumping arrangement to maintain the abrasive suspension at a minimum flow rate in the the loop to prevent the abrasive suspension from being deposited on walls of the pipes, and wherein the control system is arranged to control the pumping arrangement to maintain a flow rate of the abrasive solution in the pipes at least approximately 0.2 m/s.

11. Apparatus for delivering abrasive suspensions, comprising:

a reservoir containing an abrasive suspension;

a loop for delivering the abrasive suspension to a point of use, the loop being connected to the reservoir;

a pumping arrangement for circulating the abrasive suspension in the loop and for ensuring its return into the reservoir;

the loop and the reservoir being arranged for recovering the abrasive suspension after circulation in the loop at a recovery point of the reservoir; and a control system for controlling the pumping arrangement so as to maintain a continuous circulation of the suspension, wherein the loop comprises one or more pipes, and the control system is arranged to control the pumping arrangement to maintain the abrasive suspension at a minimum flow rate in the the loop to prevent the abrasive suspension from being deposited on walls of the pipes, and wherein the control system is arranged to control the pumping arrangement to maintain a flow rate of the abrasive suspension in the pipes no more than approximately 10 m/s.

12. Apparatus according to claim 11, wherein the control system is arranged to control the pumping arrangement to maintain a flow rate of the abrasive suspensions between 0.5 and 2 m/s.

13. Apparatus according to claim 12, wherein the control system is arranged to control the pumping arrangement to maintain the flow rate of the abrasive suspensions between approximately 1 m/s and 1.2 m/s.

14. Apparatus according to claim 1, wherein the pumping arrangement includes at least one pump.

15. Apparatus according to claim 1, wherein the pumping arrangement includes two pumps mounted in parallel, each pump being sized to operate at no more than 50% of its power during normal operation.

16. Apparatus according to claim 10, wherein the pumping arrangement includes a source of a pressurized gas connected to the reservoir.

17. Apparatus according to claim 16, wherein the pumping arrangement further includes means for nebulizing deionized water in the pressurized gas.

18. Apparatus according to claim 1, wherein the loop comprises one or more pipes, and the control system is arranged to control the pumping arrangement to maintain the abrasive suspension at a minimum flow rate in the the loop to prevent the abrasive suspension from being deposited on walls of the pipes, and the control system is arranged to control the pumping arrangement to maintain a flow rate of the abrasive solution in the pipes at least approximately 0.2 m/s.

19. Apparatus according to claim 1, wherein the loop comprises one or more pipes, and the control system is arranged to control the pumping arrangement to maintain the abrasive suspension at a minimum flow rate in the loop to prevent the abrasive suspension from being deposited on walls of the pipes, and the control system is arranged to control the pumping arrangement to maintain a flow rate of the abrasive suspension in the pipes no more than approximately 10 m/s.

20. Apparatus according to claim 1, wherein the loop comprises one or more pipes, and the control system is arranged to control the pumping arrangement to maintain the abrasive suspension at a minimum flow rate in the loop to prevent the abrasive suspension from being deposited on walls of the pipes, and the control system is arranged to control the pumping arrangement to maintain a flow rate of the abrasive suspensions between 0.5 and 2 m/s.

* * * * *